United States Patent [19]

Miyamoto

[11] 4,123,638

[45] Oct. 31, 1978

[54] HIGH SPEED SWITCHING DEVICE FOR SWITCH AND BREAKER

[76] Inventor: Motomu Miyamoto, 108 House Toritsudai, 12-21, 2-Chome, Nakane, Meguro-Ku, Tokyo, Japan

[21] Appl. No.: 698,631

[22] Filed: Jun. 22, 1976

[51] Int. Cl.[2] ..... H01H 3/00

[52] U.S. Cl. ..... 200/153 G; 200/257; 200/260

[58] Field of Search ..... 200/257, 260, 261, 153 G, 200/153 H, 17, 18

[56] References Cited

U.S. PATENT DOCUMENTS

| | | | |
|---|---|---|---|
| 320,017 | 6/1885 | Thomson | 200/153 G |
| 1,787,291 | 12/1930 | Thumin | 200/260 X |
| 3,260,805 | 7/1966 | Pihl | 200/257 X |
| 3,763,341 | 10/1973 | Wills | 200/153 G |

*Primary Examiner*—Harold Tudor
*Attorney, Agent, or Firm*—Fred Philpitt

[57] ABSTRACT

A high speed switching device constructed in such a way that the casing is formed with a hollow chamber in its inside of the partition wall for separating the poles, and a runner is slidably provided in the hollow chamber, and the runner is made to operate by a lever and plate springs, and the runner is provided with two pieces of projecting elements, and the plate spring is sandwiched, and two pieces of engaging members are provided at a predetermined interval to make the lever engageable, and the plate spring is made to have length sufficient to curve in bow shape with a predetermined degree of arc circle and its both ends are fixed and installed on the upper wall and bottom wall of the hollow chamber by means of the pressure spring, and the runner is shifted in such a way that the lever is engaged with one engaging member and the plate spring is extended in straight condition and exceeds the opposite side slightly from the straight condition and exceeds the opposite side slightly from the straight condition, and when the plate spring exceeds the straight condition instantly, the plate spring is shifted to the other end side instantly by the resilient force of the plate spring, and the runner is integrally fixed to the movable shaft, and is extended to the pole chamber and the opening side of the movable contact is fixed and the movable contact is tapered, and the stationary contact is shaped in open form with an angle corresponding to the movable contact.

3 Claims, 6 Drawing Figures

HIGH SPEED SWITCHING DEVICE FOR SWITCH AND BREAKER

BACKGROUND OF THE INVENTION

The present invention relates to a high speed switching device for switch and breaker and more particularly to a compact switching mechanism to be operated at high speed with strong force in power switch except no-fuse breaker and micro-switches. With the use of plate springs which are made of hardened hoop steel, the resilient force of the plate springs are extremely effectively worked to facilitate the remarkably high speed switching operations, and also the present device can be used from the unit having small breaking capacity to the unit having extremely large capacity, and the safe switching operations are possible, and the device of the present invention can be manufactured in an extremely narrow width with the use of the plate springs, and as a result, the device can be installed in a partition wall betwen poles, and thus the number of parts can be greatly reduced which makes it possible to the simplification of structure and compactness of the structure, and the making and breaking of the contacts can be made easily and positively.

The conventional switch and breaker employ a variety of switching methods depending on magnitudes of the voltages or currents or purpose of usuage, but in the switching mechanism for conventional switch and breaker, the motion is slow due to the use of spiral springs as the pressure spring or return spring, and accordingly there is the limitation in the switching speed, and also there is the limitation in the breaking capacity, and yet, damages of the contacts tend to occur due to the lack of stability in the quick switching of the contacts, and moreover the structure becomes complicated due to the use of the spiral spring, and it requires not only the high degree of techniques in the assembly thereof but also it makes the entire structure bulky which results in the large size device and in the limitation to determine the number of poles which are the drawbacks of the conventional switch and breaker.

SUMMARY OF THE INVENTION

An object of the present invention is to provide a high speed switching device in which plate springs made of hardened hoop steel are employed in the switching mechanism.

A still another object of the present invention is to provide a high speed switching device in which the switching can be performed at a speed faster by more than double the speed of the conventional device with the effective utilization of the plate springs, and at the same time, the switching speed can be remarkably stabilized as compared with that of the conventional device.

And yet, a further object of the present invention is to provide a high speed switching device in which a high speed switching mechanism provided with plate springs is formed which make it possible to form the switching mechanism in extremely narrow width, and therefore the mechanism can be installed in the partition wall that separate the poles, and as a result, the entire shape of the switching mechanism becomes remarkably small size and the number of parts is greatly reduced to simplify the structure thereof, and thus the assembling operation becomes extremely easy and simple.

Furthermore, another object of the present invention is to provide a switching device in which a contact mechanism is provided to make the connection and breaking of contacts easy and positive.

Finally, another object of the present invention is to provide a switching device which can be operated at high speed for contact making and breaking operations, and can be used for the unit having small breaking capacity and the unit having extremely large capacity and yet its stability is remarkably high.

DETAILED DESCRIPTION OF THE INVENTION

Figure 1:
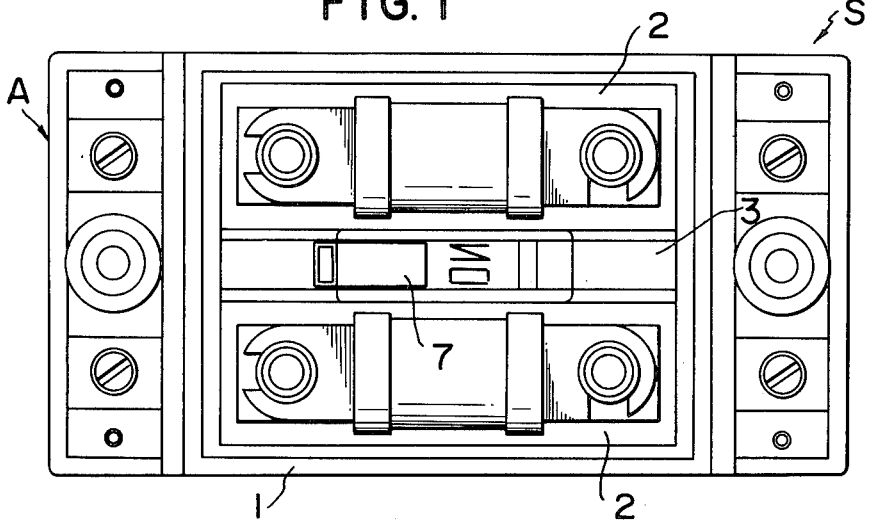
FIG. 1 is a plan view of double-pole switch.

The double-pole switch according to the present invention is shown in normal character S, and the partition wall 3 for separating the pole chamber 2 of the casing 1 is formed in a hollow chamber 4 whose inside wall is hollow, and a runner 5 is installed in the hollow chamber 4 of the partition wall 3, and the runner 5 is made to slidably move in the hollow chamber 4 by two pieces of plate springs 6, 6' made of hardened hoop steel and a lever 7 whereby a switching mechanism is formed, and a contact mechanism for making connection and breaking by the slidable transfer of the runner 5 is formed.

Figure 2:
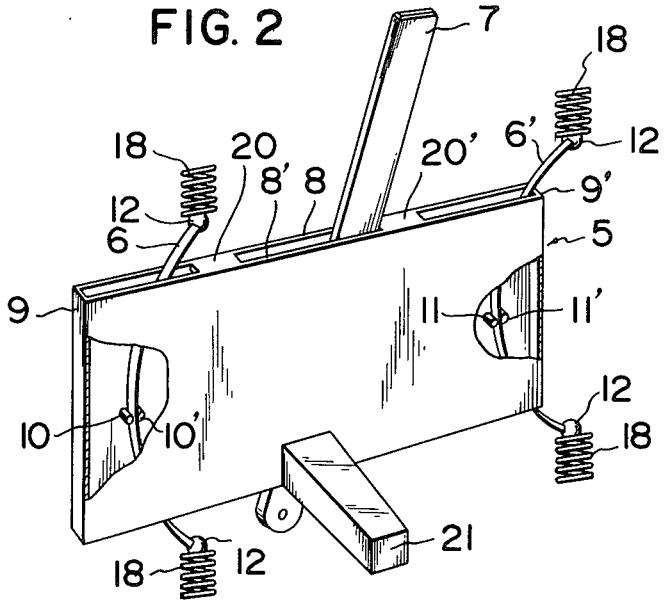
FIG. 2 is a perspective view of a runner shown with its part being cut away.

The runner 5 is provided with left and right side wall portions 8, 8' and both end side wall portions 9, 9' as shown in FIG. 2, and being formed in flat box type whose upper and lower openings run through vertically. This runner is constructed in such a way that a pair of projecting elements 10, 10' and 11, 11' are provided between the left and right side wall portions 8, 8' at the height in the center of symmetric of the one end side and the other end side of the inside, and said pair of projecting elements 10, 10' and 11, 11' are arranged in parallel at a predetermined interval and said two pieces of plate springs 6, 6' are sandwiched and positioned between each interval of said projecting elements 10, 10' and 11, 11'. The both ends of the plate springs 6, 6' are projected from the upper surface opening and lower surface opening of the runner 5 and are extended, and balls 12 are integrally formed at both ends. Concave holes 15, 15' and 16, 16' are formed at left and right symmetric positions of the upper wall 13 and bottom wall 14 of the hollow chamber formed on the partition 3 so that the balls 12 provided at both ends of the plate springs 6, 6' can be inserted and positioned, and straight holes 17, for allowing the lever 7 to run through thereof are penetrated.

The plate springs 6, 6' are shaped in a length which are curved in bow type with a predetermined curving degree, and two pieces of the plate springs 6, 6' are curved in the same direction in bow-shape to fix and position the runner 5 at one end of the other end of the hollow chamber 4 with a fixed pressure. Pressure springs 18 are inserted into the concave holes 15, and 16, formed on the upper wall 13 and bottom wall 14 of the partition wall 3 so that the pressure force of the plate springs 6, 6' is made adjustable by adjusting screws 19.

Figure 3:
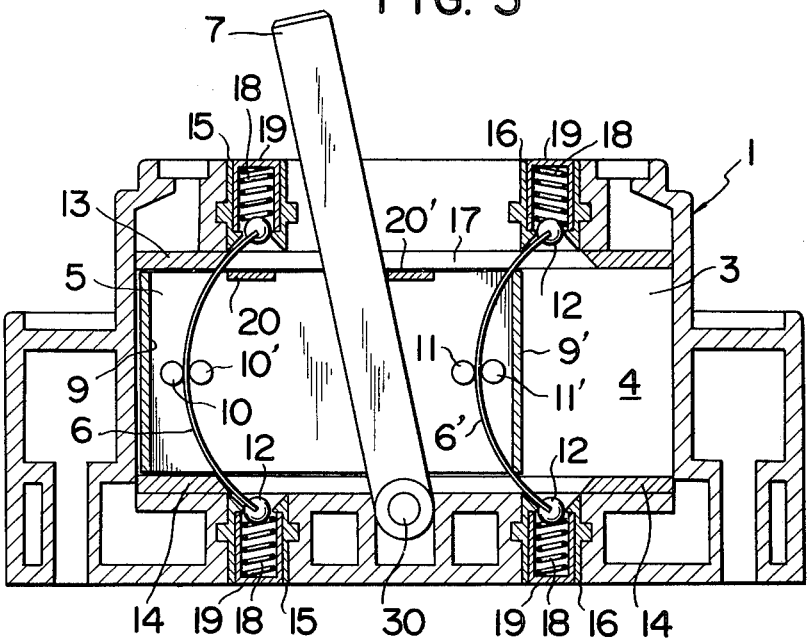
FIG. 3 is a cross section showing the runner at the open position.
Figure 4:
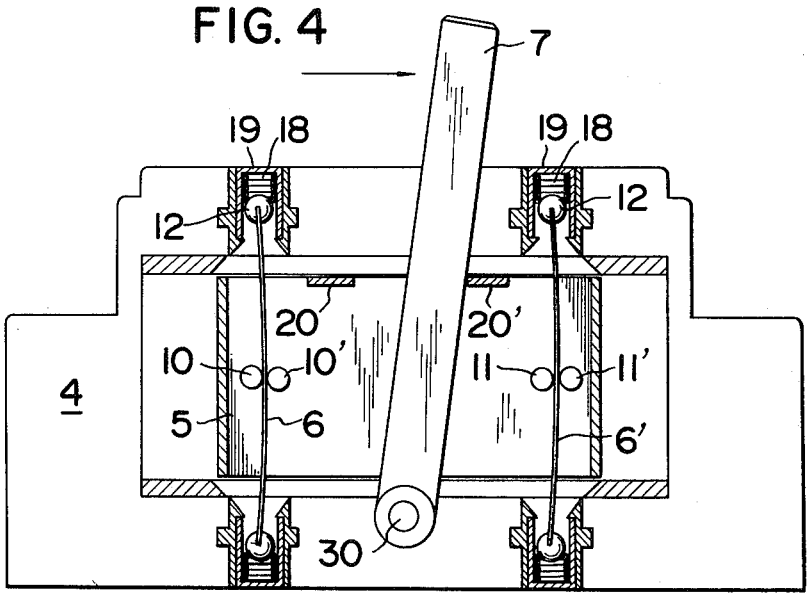
FIG. 4 is a cross section showing the transfer condition of the runner accompanied by the closing operation.
Figure 5:
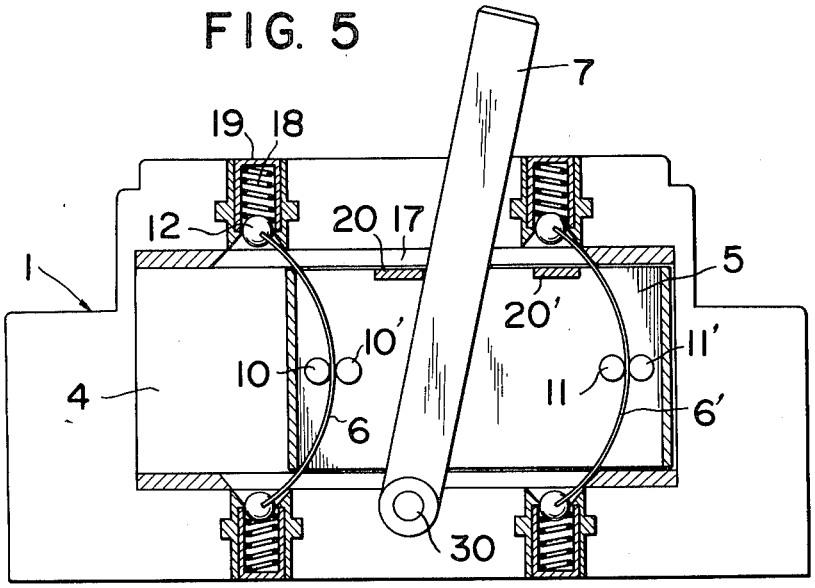
FIG. 5 is a cross section showing the runner at the closed position.
Figure 6:
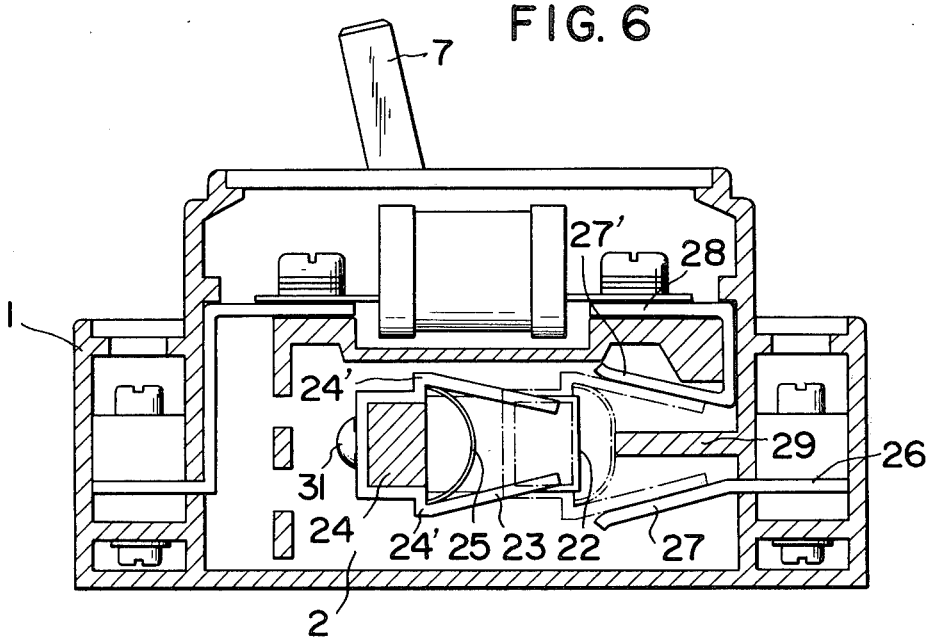
FIG. 6 is a cross section showing a contact mechanism at the open position.

The runner 5 is formed with engaging members 20, 20' at a predetermined interval at left and right symmetric in the center portion of the opening surface of the upper surface as shown in FIG. 3 through FIG. 5. And the lever 7 is pivotally installed in the center portion of the bottom wall 14 of the partition 3 at the lower end by means of a pin 30, and is made to run through the inside of the runner 5 to pass the engaging members 20, 20' of the opening of the upper surface and is projected upward from the straight hole 17 formed on the upper wall 13 of the hollow chamber 4.

The relationship between the runner 5, two pieces of plate springs 6, 6' and lever 7 is as shown in FIG. 3 and FIG. 5 where the two pieces of plate springs 6, 6' are curved in the same direction in the bow shape and the runner 5 is caused to be fixed and positioned to one end side or the other end side of the hollow chamber 4 by the pressure force of the two pieces of plate springs 6, 6'. At this time, the lever 7 is leans to the side where the runner 5 is positioned, and contacts the engaging members 20, 20' of the side opposed to the side where the runner 5 is moved. Next, when the lever 7 is raised to the perpendicular position, as shown in FIG. 4, the runner 5 is shifted to the position where the plate springs 6, 6' slightly exceed each concave hole 15, and 16, by the engaging members 20', and at the instant when the two pieces of plate springs 6, 6' exceed the concave holes 15, and 16, the runner 5 is shifted in the moving direction instantly by the resilient force of the plat springs 6, 6'. The two pieces of engaging members 20, 20 ' are provided at an interval almost identical with the transfer direction of the runner 5, and when the runner 5 is shifted by the resilient force of the plate springs 6, 6', the runner 5 is positioned in the relationship that is is separated from the lever 7 and the engaging member 20 or 20'.

The contact mechanism is constructed in such a way that a movable shaft 21 is made to project to left and right pole chambers 2, 2 through a guide hole 22 formed on the partition by fixing the movable shaft 21 integrally with the left and right side walls 8, 8' of the runner 5, and a movable contact is installed on the movable shaft 21, and a stationary contact is installed at one end side of the pole chambers 2, 2.

The movable contact is installed in such a way that a movable contact member 23 is bent in shape and is fitted to the movable shaft 21, and is fixed by a cross bar 31, and is bent and extended in tapered from forward by means of step portions 24, 24 ' bent perpendicularly at the open side, and a contact pressure adjusting spring 25 made of plate spring is curved in bow shape and is installed between the upper and lower step portions 24, 24'. The stationary contact is installed in such a way that a lower stationary contact member 27 fixed with a terminal 26 and an upper stationary contact member 27' fixed with a terminal 28 are bent so as to open with an angle corresponding to the movable contact member 23. A stationary shaft 29 is installed between the upper and lower stationary contact members 27, 27', and when the movable contact is connected to the stationary contact and is positioned, the contact pressure adjusting spring 25 is pressed by the stationary shaft 29 to apply a proper pressure to the movable contact member 23 so as to be opened, and the runner 5 is positioned at the left end of the hollow chamber 4, and the two pieces of plate springs 6, 6' are sandwiched between each pair of projecting elements 10, 10' and 11, 11', and curved in bow shape in the same left side direction, and the lever 7 is tilted to the left side, and is engaged with the engaging member 20' of the right side provided on the runner 5, and the contact member 23 of the movable contact is separated and positioned from the two pieces of contact members 27, 27' of the stationary contact. When the closing operation is carried out, and the lever 7 is tilted to the right side, the runner 5 is shifted to the right side by means of the engaging member 20', and accordingly, the plate springs 6, 6' sandwiched by the respective projecting elements 10, 10' and 11, 11' are caused to push the pressure spring 18 upward by the balls 12 of both ends, and are extended in straight length, and when the plate springs 6, 6' exceed slightly the position on the straight line connecting the vertical concave holes 15, 15' and 16, 16', the plate springs 6, 6' are repulsed in bow shape to the right side with the application of pressure force of the pressure spring 18, and the runner 5 is instantly shifted to the right side end and is positioned and the contact member 23 of the movable contact point is made to enter instantly into the contact members 27, 27' of the stationary member and to contact thereof. When the contact member 23 of the movable contact enters between the contact members 27, 27' of the stationary contact, the contact pressure adjusting spring 25 is compressed by the stationary shaft 29 and the movable contact member 23 is caused to contact strongly to the stationary contact members 27, 27'. Next, when the opening operation is performed, the lever 7 is tilted to the left side and the runner 5 is shifted to the point where two pieces of the plate springs 6, 6' are extended straightly by resisting to the pressure spring 18, and exceeds slightly the straight line condition, and at the instant when the plate springs 6, 6' exceed lightly the straight line condition, the runner 5 is shifted to the left end instantly and resiliently by the resilient force of the plate springs 6, 6' and the pressure spring 18, and the movable contact member 23 of the movable contact is instantly separated by the contact members 27, 27' of the stationary contact. At this time, the contact pressure adjusting spring 25 is separated from the stationary shaft 29 and at the same time, the opening force of the contact pressure adjusting spring 25 is lost and the contact pressure of the movable contact member 23 and the stationary contact members 27, 27' is weakened which results in easy separation.

What is claimed is:

1. A high speed device for switching an electric switch from one position to another which comprises in combination (a) a main housing chamber
(b) a runner in the form of a flattened hollow box slideably mounted within said housing chamber,
(c) at least one shaft integrally attached to said runner and extending laterally outwardly therefrom in engagement with said electric switch
(d) a lever extending completely through said runner and having one end pivotally attached to said chamber,
(e) two spaced apart plate springs extending through said runner,
(f) four spaced apart resilient mounting means in said main housing chamber for resiliently receiving and retaining the four ends of said two plate springs, the total force of the two resilient mounting means on each end of a plate spring being sufficient to cause the plate spring to take the shape of an arcuate bow, (g) two plate spring engaging means extending through the interior of said runner, each spring engaging means serving to restrict an intermediate portion of a plate spring from moving laterally with respect to said runner, (h) lever engaging means located on said runner, said lever being positioned so that movement of the lever from one position to another will move the runner laterally a sufficient distance that at least one of said plate spring engaging means will move its associated plate spring from an arcuate disposition to at least slightly beyond a straight up and down disposition, whereby movement of said lever from one position to another will move said shaft from one position to another and the natural resiliency of said plate springs will cause the runner and shaft to continue to move to the maximum extent in the direction initiated by the lever.

2. A device according to claim 1 wherein said plate springs of (d) are made of hardened hoop steel.

3. A device according to claim 1 wherein said resilient mounting means of (e) are pressure springs.

* * * * *